US005239928A

United States Patent [19]

Ricci

[11] Patent Number: 5,239,928

[45] Date of Patent: Aug. 31, 1993

[54] RELOADABLE SLUG ASSEMBLY AND METHOD FOR MAKING SAME

[76] Inventor: Vero Ricci, 106 E. Stiles Ave., Collingswood, N.J. 08108

[21] Appl. No.: 944,681

[22] Filed: Sep. 14, 1992

[51] Int. Cl.[5] ..... F42B 7/10

[52] U.S. Cl. ..... 102/439; 102/430; 102/448

[58] Field of Search ..... 102/430, 439, 448–463

[56] References Cited

U.S. PATENT DOCUMENTS

| | | | |
|---|---|---|---|
| 45,292 | 11/1864 | Wills . | |
| 96,373 | 11/1869 | Wohlgemuth . | |
| 3,215,076 | 11/1965 | Foote et al. | 102/42 |
| 3,289,586 | 12/1966 | Horn et al. | 102/42 |
| 3,726,231 | 4/1973 | Kelly et al. | 102/93 |
| 4,291,625 | 9/1981 | Stagg, Jr. | 102/449 |
| 4,569,288 | 2/1986 | Grelle et al. | 102/466 |
| 4,762,068 | 8/1988 | Lubbers | 102/439 |
| 4,938,146 | 7/1990 | Gunther et al. | 102/439 |
| 5,033,386 | 7/1991 | Vatsvog | 102/467 |

*Primary Examiner*—Harold J. Tudor

*Attorney, Agent, or Firm*—Panitch Schwarze Jacobs & Nadel

[57] ABSTRACT

A slug assembly is disclosed which is easily reloadable and which has enhanced features for achieving an accurate and dependable flight path when fired from a firearm. The slug assembly includes a hull, a projectile assembly, and a wad assembly, wherein the projectile assembly and wad assembly are secured within a cavity formed in the hull. The wad assembly includes an overpowder cup having a predetermined volume for receiving, measuring and retaining in the hull cavity a predetermined quantity of propulsive charge. The projectile assembly includes a break away area having a predetermined tensile strength such that the projectile assembly is structurally weakest at the break away area, wherein at a predetermined time after ignition of the propulsive charge inside the hull, the projectile assembly tears at the break away area. The present invention includes the slug assembly, and also includes the hull, the projectile assembly, and the wad assembly which comprise the slug assembly.

9 Claims, 7 Drawing Sheets

Fig 1
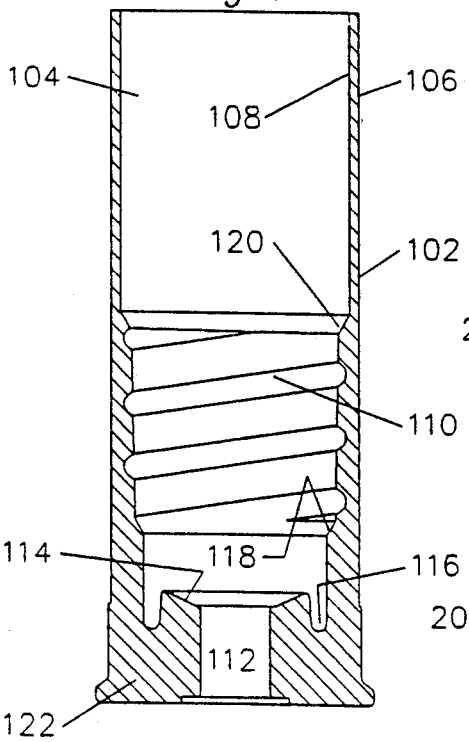
Fig 2A
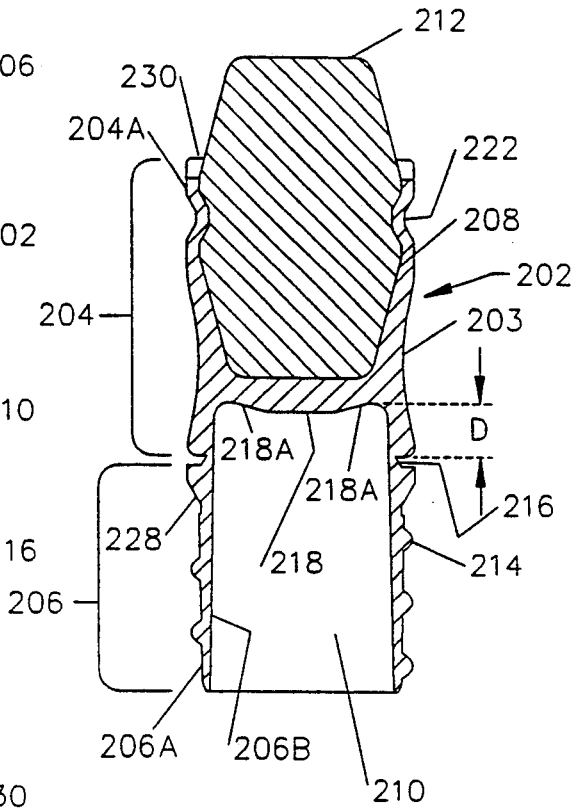
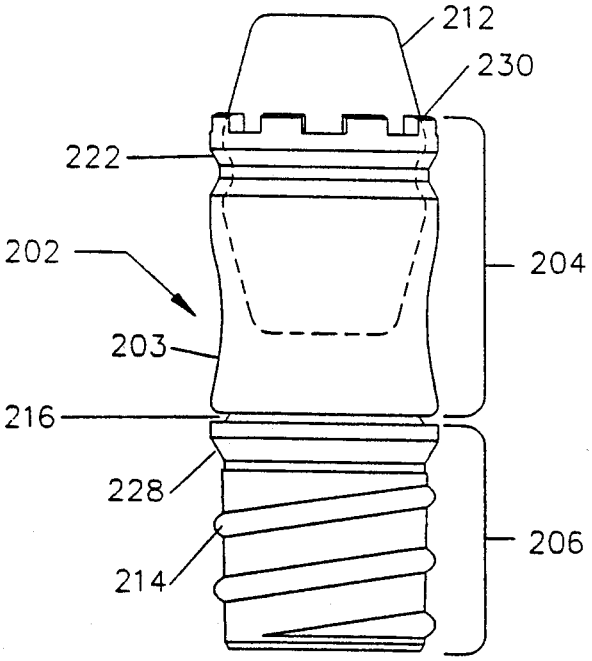
Fig 2B
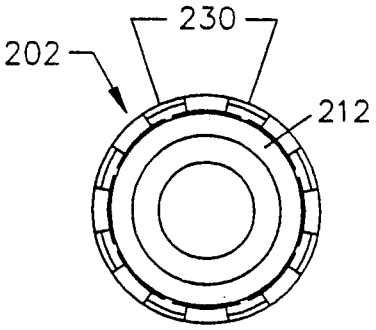
Fig 2C

*Fig 2D*
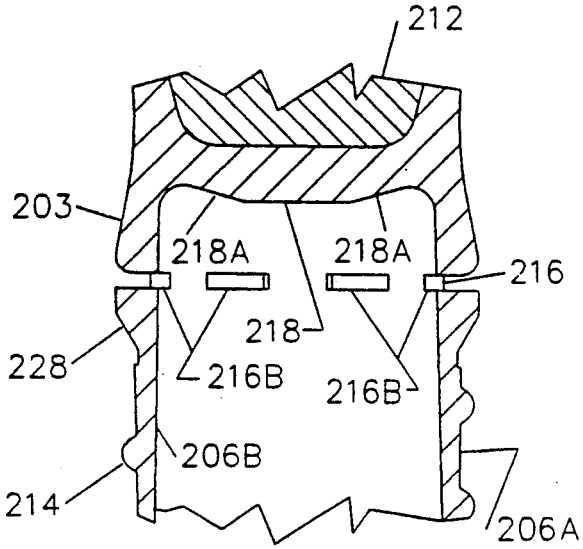
*Fig 2E*
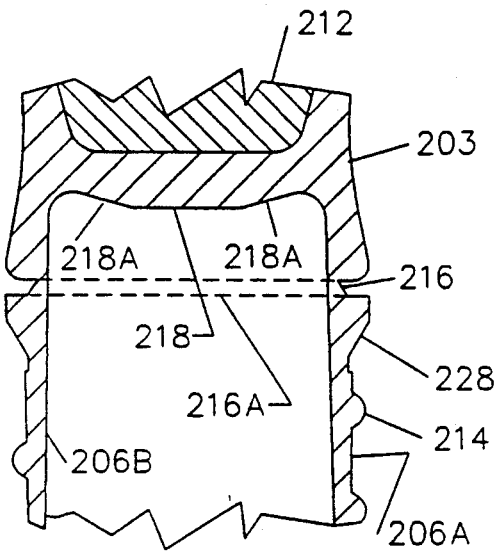
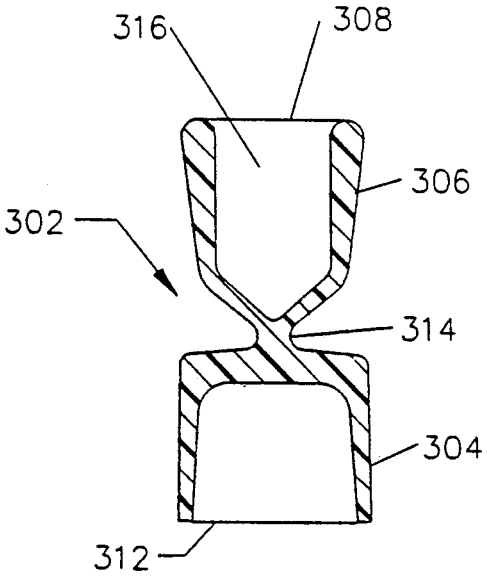
*Fig 3A*
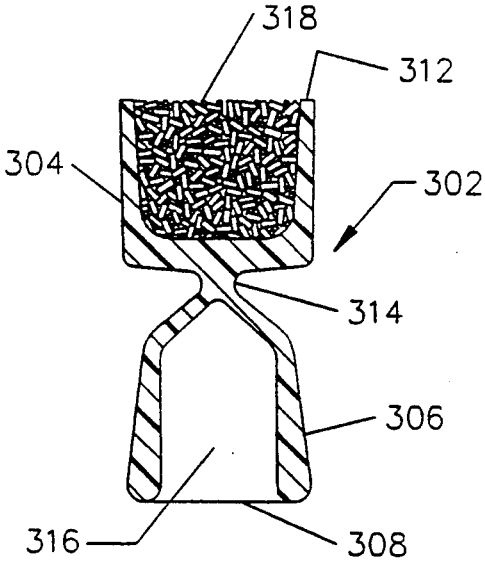
*Fig 3B*

RELOADABLE SLUG ASSEMBLY AND METHOD FOR MAKING SAME

FIELD OF THE INVENTION

The present invention relates generally to a reloadable slug cartridge or assembly, and more particularly to slug cartridge components which can be assembled and loaded using simple and/or common tools to produce a reloadable slug assembly. The terms "slug", "slug assembly" and "slug cartridge" are used interchangeably herein. Also, the terms "reloadable slug assembly" and "reusable slug assembly" are used interchangeably herein.

BACKGROUND OF THE INVENTION

Shotgun cartridges that fire solid projectiles are commonly called slugs or slug cartridges (they are also called slug assemblies herein). Local game management agencies often require that slug cartridges be used for hunting purposes, especially in heavily populated areas.

Generally, cartridges which are reloadable are advantageous as they allow sportsmen to load and reload their own ammunition, thereby resulting in substantial financial savings. Such financial savings allow sportsmen to more frequently practice (because it does not cost as much to practice) such that the sportsmen become better marksmen and, therefore, more humane hunters. Also, reloadable cartridges are advantageous because they allow skilled sportsmen to produce higher performance ammunition (for example, by adding or diminishing the amount of gun powder loaded into the cartridge, or by varying type and weight of the projectile, based on specific end uses).

Conventional cartridge components which can be assembled and loaded to produce reloadable, non-slug cartridges generally exist. However, such conventional cartridge components are generally flawed because special machinery and tools are required for assembly and loading. Specifically, special machinery and tools are necessary to precisely measure the amount of propulsive charge, such as gun powder, to be loaded into the cartridge components. Also, special machinery and tools (such as a loading press) are required to assemble the cartridge components such that the gun powder located therein is placed under a predetermined amount of pressure. As is well known, such pressure is necessary to achieve uniform burn of the gun powder, particularly for fast burning types of gun powder which are normally used as hunting loads. Further, special machinery and tools (such as crimping tools) are required to secure the cartridge components together (by crimping, for example). Further, weight scales for precise measuring of powder charge may also be required.

While conventional cartridge components which can be assembled and loaded to produce reloadable, non-slug cartridges exist, cartridge components which can be assembled and loaded to produce reloadable, slug cartridges are not generally available. This is particularly true since most conventional loading presses do not allow for convenient reloading of slug cartridges. Additionally, conventional slug cartridge components which do exist generally suffer from the same flaws which exist in conventional non-slug cartridge components (as described above). Thus, in areas where local game management agencies require the use of slug cartridges for hunting purposes, or when sportsmen prefer using slug cartridges, sportsmen are forced to rely on and use expensive, fully assembled and loaded slug cartridges.

The present invention is directed to slug cartridge components which can be easily, accurately and dependably assembled by hand using simple tools to produce reloadable slug assemblies, wherein the slug assemblies include features for achieving enhanced and reliable aerodynamic performance, such as accurate and dependable flight when fired from a firearm. The slug cartridge components of the present invention have the following attributes: integrally molded retaining means for retaining the loaded form (that is, for securing the slug cartridge components together in the slug assembly), means for measuring the proper amount of gunpowder, means for applying an appropriate and consistent amount of pressure to the gunpowder, means of repeatable alignment of components, self-wiping means to insure proper containment of gunpowder, means to insure mechanical engagement of components during the critical period of primer ignition, and means for preventing the projectile from inadvertently moving until a precise level of pressure is reached. The present invention also includes the slug assembly which results from assembling and loading the slug cartridge components.

SUMMARY OF THE INVENTION

The present invention is directed to a slug assembly which is easily reloadable and which has enhanced features for achieving an accurate and dependable flight path when fired from a firearm. Briefly stated, the slug assembly includes a substantially hollow, generally cylindrically shaped hull having a first cavity formed therein. The hull also includes an outer surface, an inner surface defining the first cavity, and first retaining means formed on a portion of the inner surface within the first cavity. The hull further includes a second cavity formed therein for receiving a primer.

The slug assembly also includes a generally cylindrically shaped projectile assembly having a first portion and a second portion. A projectile is secured in a first chamber formed in the first portion. Second retaining means is formed on an outer surface of the second portion of the projectile assembly. The second portion and a part of the first portion of the projectile assembly are positioned within the hull first cavity and secured therein by interaction of the first retaining means and second retaining means.

The slug assembly further includes a wad assembly positioned in the hull first cavity within a second chamber formed in the second portion of the projectile assembly. The wad assembly includes an overpowder cup for confining, receiving, measuring, and retaining in the hull first cavity a predetermined quantity of propulsive charge.

The projectile assembly further includes a break away area formed on the outer surface of the second portion of the projectile assembly. The break away area has a predetermined tensile strength such that the projectile assembly is structurally weakest at the break away area. At a predetermined time after ignition of the primer inside the hull second cavity and the propulsive charge inside the hull first cavity, the projectile assembly housing tears at the break away area, thereby separating the first portion of the projectile assembly from the second portion of the projectile assembly.

The present invention includes the fully assembled and loaded slug assembly, as well as the hull, the projectile assembly, and the wad assembly which comprise the slug assembly.

BRIEF DESCRIPTION OF THE DRAWINGS

The foregoing summary, as well as the following detailed description, is better understood when read in conjunction with the appended drawings. For the purpose of illustrating the invention, embodiments which are presently preferred are shown in the drawings. It is understood, however, that this invention is not limited to the precise arrangements and instrumentalities shown. In the drawings:

FIG. 1 is a sectional elevation view of a hull in accordance with the present invention;

FIG. 2A is a sectional elevation view of a projectile assembly in accordance with the present invention;

FIG. 2B is an elevation view of the projectile assembly of FIG. 2A;

FIG. 2C is a top plan view of the projectile assembly of FIG. 2A;

FIG. 2D is an enlarged sectional elevation view of the projectile assembly of FIG. 2A showing a tear away area according to a first embodiment of the present invention;

FIG. 2E is an enlarged sectional elevation view of the projectile assembly of FIG. 2A showing the tear away area according to a second embodiment of the present invention;

FIG. 3A is a sectional elevation view of a wad assembly in accordance with the present invention;

FIG. 3B is an inverted, sectional elevation view of the wad assembly of FIG. 3A wherein propulsive charge, such as gun powder, is contained and volumetrically measured in an over powder cup of the wad assembly;

DETAILED DESCRIPTION OF THE PREFERRED EMBODIMENTS

Figure 4:
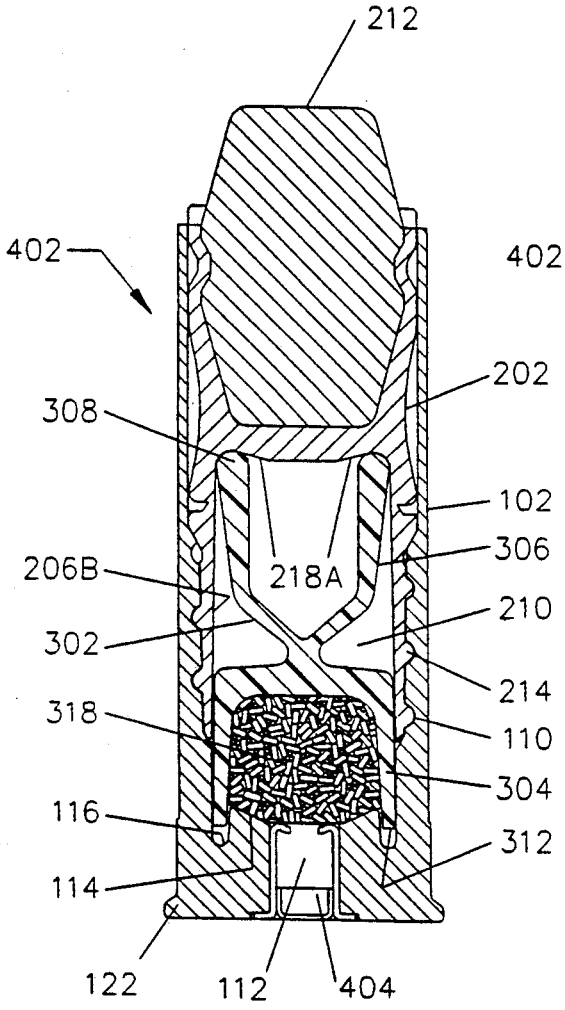
FIG. 4 is a sectional elevation view of a slug assembly in accordance with the present invention.

Certain terminology is used in the following description for convenience only and is not limiting. The words "right", "left", "lower", "upper" designate directions in the drawings to which reference is made. The words "inwardly" and "outwardly" refer to directions toward and away from, respectively, the geometric center of the slug assembly and designated parts thereof. The terminology includes the words above specifically mentioned, derivatives thereof and words of similar import.

Referring to the drawings in detail, wherein like reference numerals indicate like elements throughout, there is shown in FIG. 4 a reusable slug assembly 402 which can be accurately and dependably assembled by hand using simple tools, and which includes features for achieving enhanced aerodynamic performance such as accurate and dependable flight when fired from a firearm. The slug assembly 402 can be used as ammunition in any type of projectile-emitting firearm, such as a manual, semi-automatic, and/or automatic hand gun, rifle, cannon, etc., but the slug assembly 402 is preferably used with a shot gun having rifling grooves (the slug assembly 402 can also be used with shotguns that do not have rifling grooves).

The slug assembly 402 essentially comprises three slug cartridge components: a hull 102, a projectile assembly 202, and a wad assembly 302. In the following description of the present invention, the hull 102, the projectile assembly 202, and the wad assembly 302 are, at times, described in the context of the fully assembled slug assembly 402. However, it should be understood that such manner of describing the present invention is adopted herein for convenience purposes only, and is not meant to diminish in any way the individual importance and significance of the hull 102, the projectile assembly 202, and the wad assembly 302. It should further be understood that the present invention includes the hull 102, the projectile assembly 202, the wad assembly 302, as well as the fully assembled slug assembly 402 which is produced by assembling the hull 102, the projectile assembly 202, and the wad assembly 302.

As noted above, the slug assembly 402 includes a substantially hollow, generally cylindrically shaped hull 102. The hull 102 is preferably made from plastic, but can also be made from any material capable of withstanding the forces associated with a slug assembly being fired from a firearm. For example, metal (such as brass) may be used to construct all or parts of the hull 102 (such as the lower rim 122 of the hull 102).

As best shown in FIG. 1, the hull 102 includes a first cavity 104 formed therein. The hull 102 also includes an outer surface 106 and an inner surface 108 wherein the inner surface 108 defines the first cavity 104. The hull 102 further includes a second cavity 112 formed therein for receiving a primer 404 (shown in FIG. 4). The primer 404 can be of a type that is generally associated with shotgun cartridges, and is received and is pressed securely in the second cavity 112 in a well-known manner.

The inner surface 108 of the hull 102 which defines the first cavity 104 includes an angled lower surface or segment 114 proximate the second cavity 112 of the hull 102. A circular channel 116 is formed in the lower surface 114 of the hull 102. As described in greater detail below, the angled lower surface 114 and the circular channel 116 are used to apply a specific amount of compressive force to a propulsive charge 318 (see FIG. 4) contained in the hull first cavity 104 when the slug assembly 402 is assembled, such that uniform burning of the propulsive charge 318 inside the hull first cavity 104 is achieved when the propulsive charge 318 is ignited, thereby resulting in accurate firing of the slug assembly 402 from a firearm.

A first retaining means such as first threading 110 is formed on a lower portion of the inner surface 108 of the hull 102 within the first cavity 104. The first threading 110 preferably includes a sectional design that is conventionally found in plastic and glass bottles, but could be any other type of threading suitable for securing together the hull 102 and the projectile assembly 202 (as described below), such as Acme threading. However, it should be understood that the first retaining means could alternatively be implemented using other types of securing mechanisms which are hand operable, such as snap and lock securing mechanisms, quarter turn threading, lug and retaining cavity, etc.

The first threading 110 includes a base forcing cone 118 formed at one end of the first threading 110 and a mid forcing cone 120 formed at the other end of the first threading 110. The base forcing cone 118 and the mid forcing cone 120 aid in ensuring that the slug assembly 402 is reliably and dependably put together during every assembly. The base forcing cone 118 secures in a concentric fashion a projectile assembly 202 (described below) in the first cavity 104 of the hull 102. The mid forcing cone 120 acts as a guide to concentrically locate the projectile assembly 202 in the first cavity 104 of the hull 102 as the projectile assembly 202 is being inserted into the first cavity 104. Also, the mid forcing cone 120 represents an absolute stopping point when the projectile assembly 202 is inserted into the first cavity 104 of the hull 102.

As noted above, and referring again to FIG. 4, the slug assembly 402 also includes a generally cylindrically shaped projectile assembly 202. As best shown in FIG. 2A, the projectile assembly 202 includes a projectile assembly housing 203 preferably made from plastic (although the housing 203 can be made from metal and/or other materials). The projectile assembly housing 203 includes a first portion (or jacket) 204 and a second portion 206, wherein a first chamber 208 is formed in the first portion 204 and a second chamber 210 is formed in the second portion 206. The projectile assembly 202 also includes an interior wall 218 positioned within the housing 203 between the first and second chambers 208, 210 such that the interior wall 218 separates the first chamber 208 from the second chamber 210. Within the second chamber 210, circumferential portions of the interior wall 218 are upwardly angled toward the first chamber 208. The angled circumferential portions of the interior wall 218 are designated generally by 218A.

A projectile 212 is secured in the first chamber 208 formed in the first portion 204 of the projectile assembly housing 203. The projectile 212 is preferably made of heavier metals, such as a lead ball or cylinder contained in an outer plastic jacket (wherein the projectile assembly jacket 204 represents the outer jacket). However, it should be understood that the present invention is not limited to the type of projectile used. For example, the scope of the present invention includes replacing the projectile 212 as shown in FIG. 2A and described above with an appropriately designed nail driver attachment, a hypodermic needle, etc.

The projectile 212 is secured within the first chamber 208 by a groove 222 having a predetermined thickness formed in the first portion 204 of the projectile assembly housing 203. As those skilled in the art will appreciate, the groove 222 secures the projectile 212 within the jacket 204 and deters expansion of the projectile 212 when the projectile 212 impacts a target and the degree of such expansion deterrence depends upon the thickness of the groove 222. The scope of the present invention includes the manufacture of projectile assembly housings 203 having grooves 222 of different widths in order to produce slug assemblies 402 having different expansion deterrence factors and suitable for different uses.

A second retaining means such as second threading 214 is formed on an outer surface 206A of the second portion 206 of the projectile assembly 202. The second threading 214 of the projectile assembly 202 is of the same design and complementary to the first threading 110 of the hull 102. As shown in FIG. 4, when the slug assembly 402 is fully assembled, the second portion 206 and a part of the first portion 204 of the projectile assembly 202 are positioned within the first cavity 104 of the hull 102 and secured therein by interaction of the first threading 110 of the hull 102 with the second threading 214 of the projectile assembly 202.

Referring again to FIG. 2A, the projectile assembly 202 further includes a break away area 216 formed on the outer surface 206A of the second portion 206 of the projectile assembly housing 203. The break away area 216 has a predetermined tensile strength such that the projectile assembly housing 203 is structurally weakest at the break away area 216. At a predetermined time after ignition of the primer 404 inside the hull second cavity 112 and the propulsive charge 318 (described below) inside the hull first cavity 104, the projectile assembly housing 203 tears at the break away area 216, thereby separating the first portion 204 (and a part 502 of the second portion 206, as described below) from the second portion 206 of the projectile assembly housing 203 (see FIG. 5B). The break away area 216 is preferably positioned on the outer surface 206A of the second portion 206 of the projectile assembly housing 203 a predetermined distance D from the interior wall 218 such that upon tearing of the projectile assembly housing 203 at the break away area 216, a part 502 of the second portion 206 of the projectile assembly housing 203 extending from the interior wall 218 to the break away area 216 remains attached to the first portion 204 of the projectile assembly housing 203. The first portion 204 (with the projectile 212 secured in the first chamber 208 of the first portion 204) and the part 502 of the second portion 206 remaining attached to the first portion 204 are hereinafter collectively called the detached jacketed projectile assembly or the separated first portion 504. As further described below, the attached part 502 of the detached projectile assembly 504 forms an aerodynamic skirt during flight of the detached projectile assembly 504 such that the flight of the detached projectile assembly 504 has improved aerodynamic stability and a trailing edge that is lighter than the leading edge, resulting in accurate and dependable flight.

As best shown in FIG. 2E, the break away area 216 includes an annular groove 216A formed on the outer surface 206A of the second portion 206 of the projectile assembly housing 203. The annular groove 216A has a predefined width and depth such that the annular groove 216A has a tensile strength corresponding to the predetermined tensile strength of the break away area 216. As those skilled in the art will appreciate, the precise values of the predetermined width and depth of the annular groove 216A depends on many factors including the overall tensile strength of the projectile assembly housing 203 and the desired clean tear away edge and timing of the projectile assembly housing 203.

As best shown in FIG. 2D, the break away area 216 alternatively includes a plurality of perforations 216B formed on the outer surface 206A of the second portion 206 of the projectile assembly housing 203. Each of the perforations 216B includes a predetermined width, length and depth such that the perforations 216B have a combined tensile strength corresponding to the predetermined tensile strength of the break away area 216. As those skilled in the art will appreciate, the precise values of the predetermined width, length and depth of the perforations 216B depends on many factors, such as the overall tensile strength of the projectile assembly housing 203 and the desired tear away timing of the projectile assembly housing 203.

The break away area 216 includes a tapered entry edge 228 which facilitates insertion of the projectile assembly 202 into the first cavity 104 of the hull 102 when the slug assembly 402 is being assembled (as described below). Specifically, the diameter of the tapered entry edge 228 is slightly greater than the diameter of all other portions of the projectile assembly 202. Therefore, the projectile assembly 202 is easily inserted into the first cavity 104 of the hull 102 because the tapered entry edge 228 retains the hull 102 at a diameter that allows easy passage of the projectile assembly 202 into the first cavity of the hull 102.

Referring to FIGS. 2B and 2C, the projectile assembly 202 also includes grooves or teeth 230. The grooves 230 are used in conjunction with a tool 602 (shown in FIG. 6A and discussed in detail below) to assemble the slug assembly 402. Instead of grooves, the projectile assembly 202 could including knurling, as commonly found on screw caps. Such knurling could also be used with the tool 602 to assemble the slug assembly 402. Assembly of the slug assembly 402 is discussed further below.

As noted above, and referring again to FIG. 4, the slug assembly 402 also includes a wad assembly 302 which is preferably made using plastic but which could also be made using other materials which are sufficiently strong to withstand the forces associated with exploding primers and propulsive charge, and also sufficiently flexible to withstand the flexing required of a forcing portion 306 of the wad assembly 302 (as described below). Such other materials include rubber, compressible plastic fiber, cork, foam, etc. The wad assembly 302 is positioned in the first cavity 104 of the hull 102 within the second chamber 210 formed in the second portion 206 of the projectile assembly housing 203. As best shown in FIG. 3B, the wad assembly 302 includes means, such as an overpowder cup 304, for receiving, volumetrically measuring, and retaining a predetermined quantity of propulsive charge 318, such as gun powder. The overpowder cup 304 includes a generally circular edge or rim 312 which defines an open end of the overpowder cup 304 to receive the predetermined quantity of propulsive charge 318 into the overpowder cup 304. The overpowder cup 304 is similar in construction to a measuring scoop such that the overpowder cup 304 can be filled with propulsive charge by, for example, immersing the overpowder cup 304 into a container of loose propulsive charge or by pouring loose propulsive charge into the overpowder cup 304 until the overpowder cup 304 is full or slightly overflowing with propulsive charge. When the overpowder cup 304 is full or slightly overflowing with propulsive charge, the excess propulsive charge above the rim 312 of the overpowder cup can be skimmed off using a straight edge, such as a knife. Thus, special tools are not required to load the slug assembly 402 of the present invention with a predetermined amount of propulsive charge.

The scope of the present invention includes multiple wad assemblies 302 having overpowder cups 304 of different sizes to accommodate different types and quantities of gun powder and different uses and applications of ammunition. Preferably, the wad assemblies 302 are marked in some manner to identify the sizes of their respective overpowder cups 304, such as color coding the wad assemblies 302. The scope of the present invention also includes preloaded wad assemblies 302, wherein precise amounts of propulsive charge are loaded into the overpowder cups 304 of the wad assemblies 302 and then the o openings of the overpowder cups 304 (defined by the rim 312) are sealed using a material that readily burns when contacted with flash from an ignited primer, such as a very thin combustible material, such as cotton, gauze, paper, etc. The material can be attached to the rim 312 of the overpowder cup 304 using mechanical means (such as crimping) or chemical means (such as adhesive bonding), or any other suitable type of attachment means.

As shown in FIG. 4, when the wad assembly 302 is inserted into the hull first cavity 104, the rim 312 of the overpowder cup 304 is inserted into the Circular channel 116 formed in the angled lower surface 114 of the hull 102. As the rim 312 of the overpowder cup 304 is inserted into the circular channel 116, the propulsive charge 318 retained in the overpowder cup 304 contacts the angled lower surface 114 of the hull 102 and is thereby compressed and uniformly packed, thereby eliminating any air pockets in the propulsive charge 318, such that uniform burning of the propulsive charge 318 is achieved when the propulsive charge 318 is ignited. Note that compression of the propulsive charge 318 is facilitated by the angled nature of the lower surface 114.

As further shown in FIG. 4, when the slug assembly 402 is fully assembled, the overpowder cup 304 contacts an inner surface 206B which defines the second chamber 210 of the projectile assembly 202 (such contact is achieved by making the overpowder cup 304 a precise, predetermined size such that the overpowder cup 304 fits snugly within the hull first cavity 104 and the projectile assembly second chamber 210). Such contact ensures engagement of the first threading 110 and the second threading 214 when the slug assembly 402 is being assembled, and also ensures continued engagement of the first threading 110 and the second threading 214 when the slug assembly 402 is fired from a firearm. Such contact, or self-wiping, also ensures containment of the propulsive charge 318 in the overpowder cup 304.

Figure 5A:
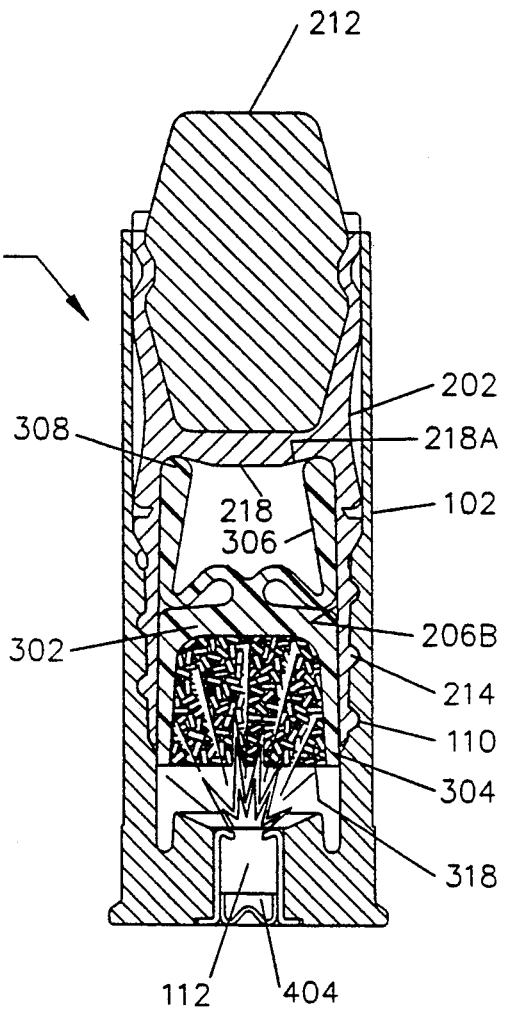
FIGS. 5A-5E are time sequenced elevation views which illustrate the slug assembly of a preferred embodiment of the present invention being fired from a firearm.

Referring to FIG. 3A, the wad assembly 302 further includes a flexible generally hollow, generally concave shaped, generally collapsible forcing portion 306 integral with the overpowder cup 304 via a generally Y-shaped cylindrical section 314. The forcing portion 306 includes a chamber 316 and a generally circular edge or rim 308 which defines an open end of the chamber 316 of the forcing portion 306. As shown in FIG. 4, the rim 308 of the forcing portion 306 abuts the interior wall 218 of the projectile assembly 202 within the second chamber 210 of the projectile assembly 202. Specifically, the rim 308 of the forcing portion 306 abuts the interior wall 218 proximate the angled circumferential portions 218A of the interior wall 218 next to the inner surface 206B of the second portion 206 of the projectile assembly housing 203. As shown in FIG. 5A, upon ignition of the primer 404, the forcing portion 306 collapses and becomes generally convex shaped as the forcing portion 306 exerts outward pressure against the interior wall 218 of the projectile assembly 202. In becoming generally convex-shaped, the forcing portion 306 rotates outward about the rim 308 (such rotation is ensured by the angled nature of the circumferential portions 218A of the interior wall 218), such that the forcing portion 306 engages the inner surface 206B of the second portion 206 of the projectile assembly housing 203. Such engagement seals expanding gases (resulting from the ignition and burning of the primer 404 and propulsive charge 318) within the hull first cavity 104. Also, such engagement ensures that the first threading 110 of the hull 102 remains secured with the second threading 214 of the projectile assembly 202. Additionally, such engagement prevents the propulsive charge 318 contained in the overpowder cup 304 from escaping the overpowder cup 304.

Referring again to FIG. 3A, the Y-shaped cylindrical section 314 which connects the overpowder cup 304 to the forcing portion 306 in the wad assembly 302 partially absorbs the initial shock generated when the primer 404 and propulsive charge 318 are ignited, thereby further ensuring uniform burning of the propulsive charge 318. Air exists in the chamber 316 of the forcing portion 306 such that upon ignition of the primer 404 and propulsive charge 318 and subsequent inversion of the forcing portion 306, the air in the chamber 316 compresses and thereby assists the Y-shape cylindric section 314 in absorbing the shock generated by such ignition.

The slug assembly 402 of the present invention is further described below with reference to FIGS. 5A-5E, which illustrate the slug assembly 402 being fired from a barrel 506 of a firearm (note that only the barrel 504 of the firearm is shown, and that the barrel 504 is shown only in FIGS. 5D and 5E).

FIG. 5A depicts the slug assembly 402 slightly after ignition of the primer 404 in the second cavity 112 of the hull 102. Note that the propulsive charge 318 in the overpowder cup 304 of the wad assembly 302 has not ignited. The flash burning of primer materials from ignition of the primer 404 causes the overpowder cup 304 of the wad assembly 302 to travel slightly upward. However, upward movement of the wad assembly 302 itself is temporarily prevented by the weight of the projectile 212 secured in the first chamber 208 of the projectile assembly 202. Therefore, the forcing portion 306 of the wad assembly 302 partially inverts and becomes generally convex shaped, such that the forcing portion 306 absorbs the initial shock of the ignited primer (as described above). As the forcing portion 306 becomes generally convex shaped and engages the inner surface 206B of the projectile assembly 202 (as described above), the walls of the forcing portion 306 vertically align with the walls of the overpowder cup 304 such that all forces resulting from the expanding gases of the ignited gun powder act in a single upward direction to apply pressure against the interior wall 218 of the projectile assembly 202. As those skilled in the art will appreciate, the initial travel of the overpowder cup 304 as described above ensures uniform ignition and burn of the propulsive charge 318 in the overpowder cup 304.

Figure 5B:
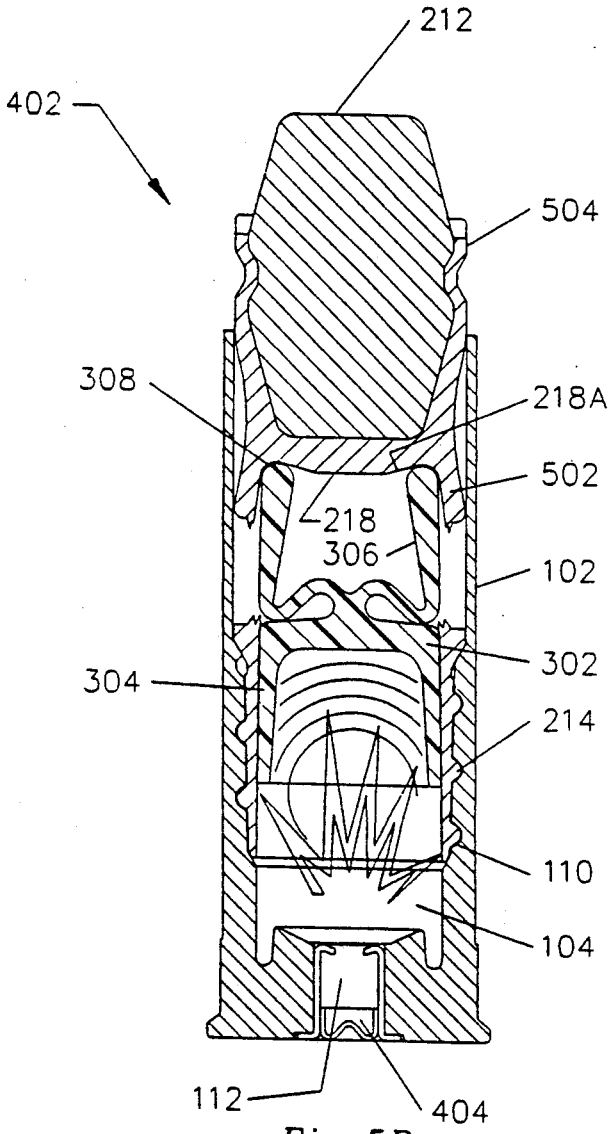

Referring now to FIG. 5B, increasing pressure from rapidly expanding gases resulting from the burning of the propulsive charge 318 in the overpowder cup 304 causes the wad assembly 302 to apply additional upward pressure against the interior wall 218 (and specifically the angled portions 218A of the interior wall 218) of the projectile assembly 202. Such pressure exerted by the wad assembly 302 against the interior wall 218 of the projectile assembly 202 is enhanced by the alignment of the walls of the forcing portion 306 with the walls of the overpowder cup 304 (as described above). As a result of the upward pressure applied against the interior wall 218 of the projectile assembly 202, the projectile assembly housing 203 tears at the break away area 216. As noted above, the break away area 216 is positioned on the outer surface 206A of the projectile assembly housing 203 such that upon tearing of the projectile assembly housing 203 at the break away area 216, a part 502 of the second portion 206 of the projectile assembly housing 203 extending from the interior wall 218 to the break away area 216 remains attached to the first portion 204 of the projectile assembly housing 203. As also noted above, the first portion 204 (with the projectile 212 secured in the first chamber 208 of the first portion 204) and the part 502 of the second portion 206 remaining attached to the first portion 204 are collectively called the detached projectile assembly or separated first portion 504. The attached part 502 of the detached projectile assembly 504 forms an aerodynamic skirt during flight of the detached projectile assembly 504 such that in-flight stability and accuracy of the detached projectile assembly 504 is enhanced. It should be noted that the break away area 216 is designed and manufactured such that the break away area 216 tears in an even tear line, although a ragged tear line is shown in FIG. 5B-5E for illustrative purposes. As those skilled in the art will appreciate, an even tear line reduces the vortex action of disturbed air as the detached projectile assembly 504 travels forward, thereby enhancing accuracy of the detached projectile assembly 504.

Figure 5C:
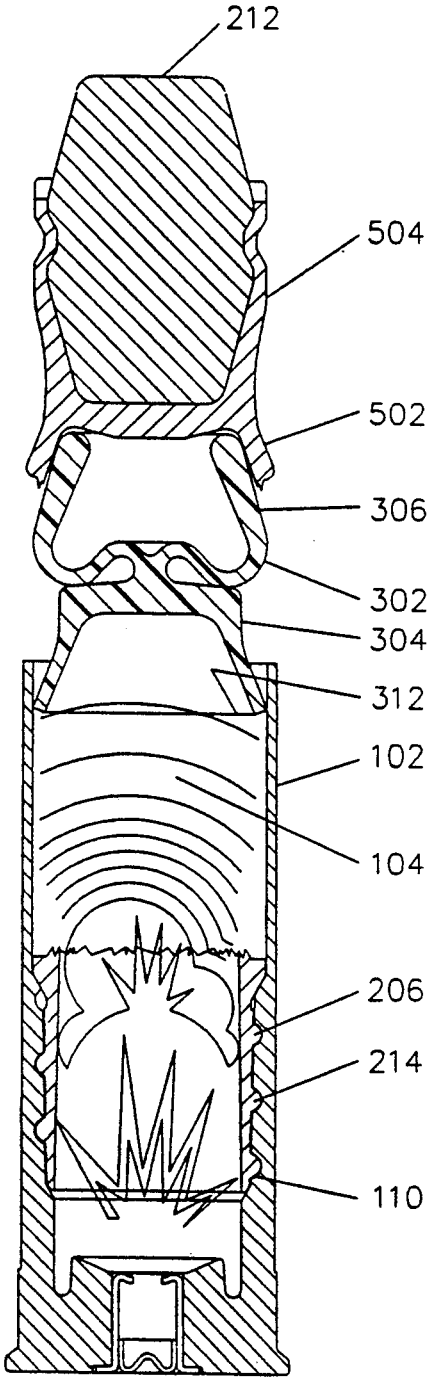
Figure 5D:
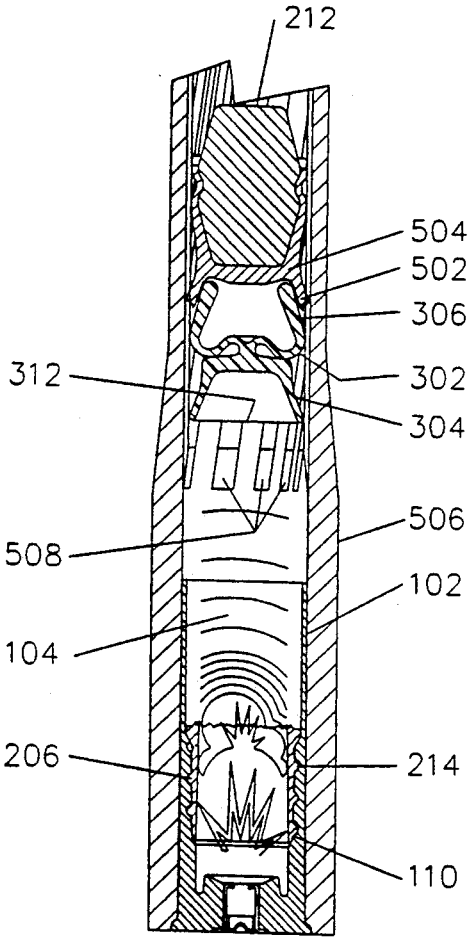

FIGS. 5C and 5D show the detached projectile assembly 504 exiting the first cavity 104 of the hull 102 and traveling through the barrel 506 of the firearm. The detached projectile assembly 504 is propelled through the barrel 506 of the firearm by the expanding gases resulting from the burning of the propulsive charge 318 in the overpowder cup 304 of the wad assembly 302. Such expanding gases also propel the wad assembly 302 through the barrel 506 of the firearm and cause the wad assembly 302 to remain attached to the detached projectile assembly 504. As the detached projectile assembly 504 and the wad assembly 302 exit the first cavity 104 of the hull 102, the expanding gases cause the forcing portion 306 of the wad assembly 302 and the rim 312 of the overpowder cup 304 to bellow outward and engage interior surfaces of the barrel 506, including rifling grooves 508. The expanding gases also cause the attached part 502 to bellow outward and engage interior surfaces of the barrel 506, including the rifling grooves 508. Such engagement with the interior surfaces of the barrel 506 seals the expanding gases within the barrel 506, thereby causing all of the forces to act against the lower portion of the projectile. Additionally, such engagement with the rifling grooves 508 of the barrel 506 cause the detached projectile assembly 504 to spin. As those skilled in the art will appreciate, such spinning of the detached projectile assembly 504 enhances in-flight accuracy and stability. It should be noted that the projectile assembly 202 could also include recesses (not shown) formed in an outer surface 204A of the first portion 204 of the projectile assembly housing 202 for engaging the rifling grooves 508.

Figure 5E:
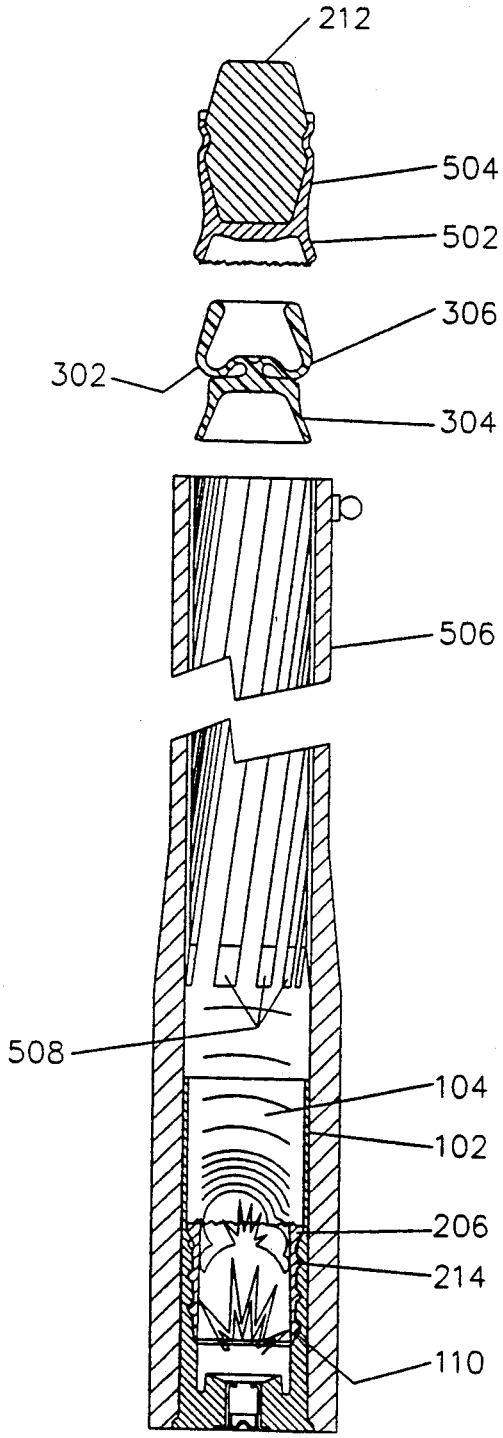

FIG. 5E depicts the detached projectile assembly 504 and the wad assembly 302 after the detached projectile assembly 504 and the wad assembly 302 have exited the barrel 506 of the firearm. After exiting the barrel 506, the wad assembly 302 separates from the detached projectile assembly 504 due to the lesser weight of the wad assembly 302 relative to the detached projectile assembly 504 (and particularly the projectile 212) and the great amount of air resistance. The attached part 502 of the detached projectile assembly 504 bellows outwardly such that the attached part 502 forms an aerodynamic skirt during flight of the detached projectile assembly 504, thereby enhancing in-flight stability and accuracy of the detached projectile assembly 504.

Note that the hull 102 remains in the barrel 506 (subject to either manual or automatic ejection from the barrel 506). Also, the second portion 206 of the projectile assembly housing 203 remains secured in the first cavity 104 of the hull 102 due to the engagement of the first threading 110 of the hull 102 and the second threading 214 of the projectile assembly 202. The hull 102 can be reused.

Figure 6A:
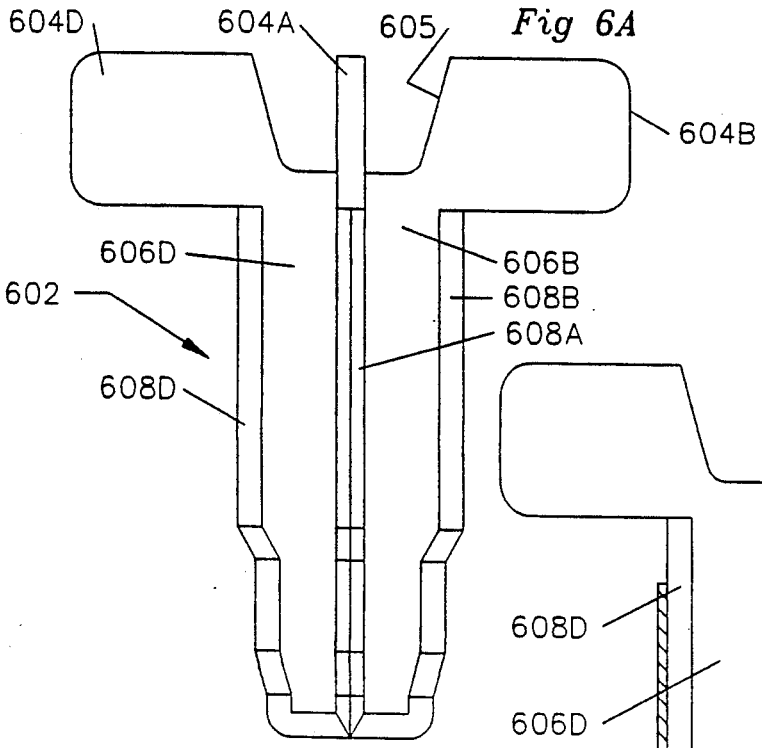
FIG. 6A is an elevation view of a tool for assembling and disassembling the slug assembly in accordance with the present invention.
Figure 6B:
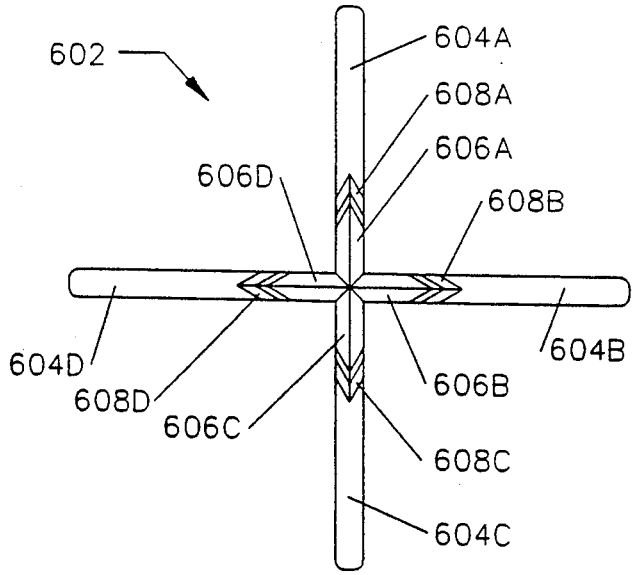
FIG. 6B is a bottom plan view of the tool of FIG. 6A.

FIG. 6A is an elevated view of a tool 602 for assembling and disassembling the slug assembly 402. FIG. 6B is a bottom plan view of the tool 602. The tool 602 includes a handle 604 having handle edges 604A, 604B, 604C and 604D, wherein handle edges 604A and 604C are arranged generally perpendicular to handle edges 604B and 604D. A seat 605 is formed in the handle 604 wherein the seat 605 generally conforms to the shape of the exposed portion of the projectile 212 (that is, the portion of the projectile 212 not within the first chamber 208 of the projectile assembly 202). The handle 604 is attached to a shaft 606 which includes four shaft edges 606A, 606B, 606C and 606D, wherein shaft edges 606A and 606C are arranged generally perpendicular to shaft edges 606B and 606D. Sharp blades 608A, 608B, 608C and 608D are attached to the shaft edges 606A, 606B, 606C and 606D, respectively. While the slug assembly 402 is preferably assembled and disassembled using the tool 602, the slug assembly 402 can be assembled and disassembled using tools which are variants to the tool 602, such as a flat tool having only two shaft edges 606A and 606C or 606B and 606D, or a tool like that shown in FIGS. 6A and 6B but having a circular cross-section. Also, the slug assembly 402 can be assembled and disassembled using commonly available tools such as a pocket knife and a plier.

Figure 8:
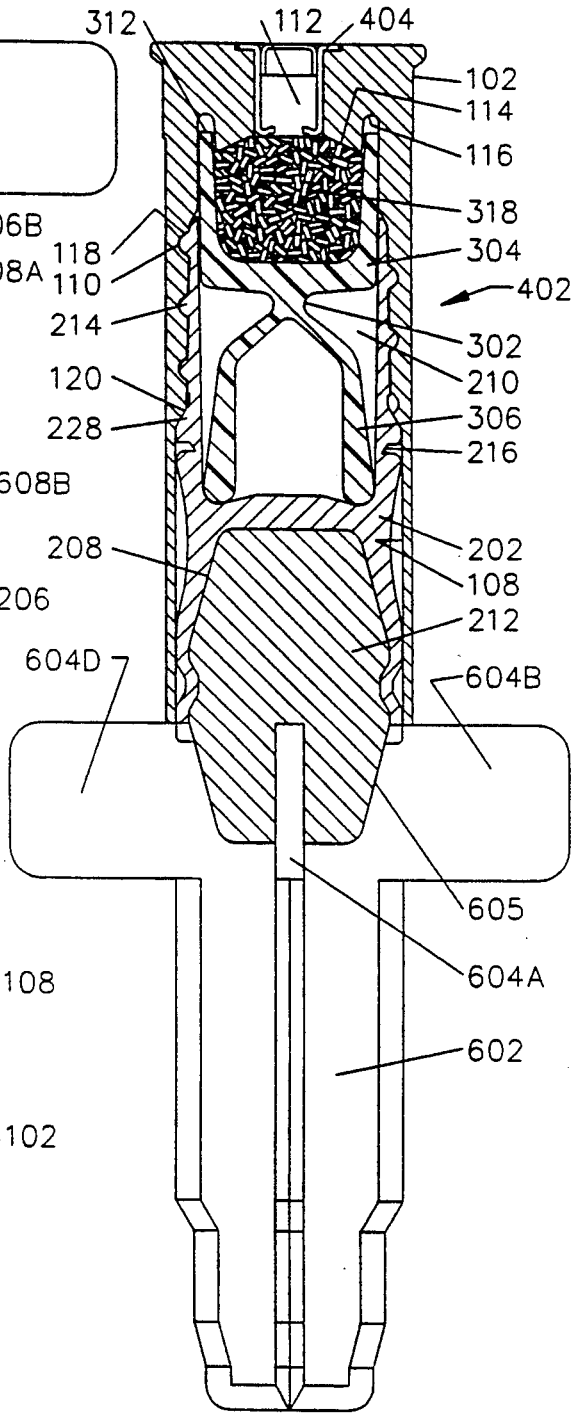
FIG. 8 is a sectional elevation view which illustrates a method for assembling a slug assembly in accordance with the present invention.

A method for assembling the slug assembly 402 of the present invention shall now be described with reference to FIG. 8. In preparation of assembling the slug assembly 402, a hull 102, a projectile assembly 202, and a wad assembly 302, all of which were described above in great detail, are provided. The slug assembly 402 is then assembled as follows. Propulsive charge 318 is inserted into an overpowder cup 304 formed in the wad assembly 302. As described above, the overpowder cup 304 has a predetermined volume such that the overpowder cup 304 receives and retains a predetermined quantity of the propulsive charge 318. Many techniques exist for inserting propulsive charge into the overpowder cup 304, such as emerging the overpowder cup 304 into a container of propulsive charge or by pouring propulsive charge into the overpowder cup 304 until the overpowder cup 304 is full or slightly overflowing. Once the overpowder cup 304 is full or slightly overflowing with propulsive charge, the excess propulsive charge above a circular edge or rim 312 of the overpowder cup 304 is skimmed off using a straight edge, such as a knife.

Then, the wad assembly 302 is inserted and secured in a second chamber 210 of the projectile assembly 202. Specifically, a forcing portion 306 of the wad assembly 302 is inserted into the second chamber 210 of the projectile assembly 202 until the forcing portion 306 abuts an interior wall 218 formed within the projectile assembly 202. As noted above, the interior wall 218 separates a first chamber 208 (wherein a projectile 212 is secured) of the projectile assembly 202 from the second chamber 210 of the projectile assembly 202. As the forcing portion 306 is inserted into the second chamber 210 of the projectile assembly 202, the overpowder cup 304 is oriented in an upward direction such that the propulsive charge 318 contained in the overpowder cup 304 is not allowed to escape from the overpowder cup 304.

The projectile assembly 202 with the wad assembly 302 secured in the second chamber 210 of the projectile assembly are then inserted into a first cavity 104 formed in the hull 102 wherein the overpowder cup 304 of the wad assembly 302 is inserted first into the first cavity 104 of the hull 102. The projectile assembly 202 and the wad assembly 302 secured in the second chamber 210 of the projectile assembly 202 are then secured inside the first cavity 104 of the hull 102 by engaging a first retaining means such as first threading 110 formed on an inner surface 108 of the hull 102 with a second retaining means such as second threading 214 formed on an outer surface 206A of the projectile assembly 202. As noted above, a base forcing cone 118 and a mid forcing cone 120 of the first threading 110 in the hull 102 ensures that the projectile assembly 202 is reliably and dependably inserted into the first cavity 104 of the hull 102. Additionally, a tapered entry edge 228 of the projectile assembly 202 facilitates insertion of the projectile assembly 202 into the first cavity 104 of the hull 102. Preferably, the tool 602 is used to secure the projectile assembly 202 and the wad assembly 302 inside the hull 102. Specifically, the projectile 212 of the projectile assembly 202 rests in the seat 605 of the tool 602 and the handle edges 604A, 604B, 604C and 604D of the tool 602 engage the teeth 230 of the projectile assembly 202. Then, the tool 602 is used to screw the projectile assembly 202 (and specifically the second threading 214 of the projectile assembly 202) into the hull first cavity 104 (and specifically the first threading 110 of the hull 102). It should be understood that any suitable type of tool could alternatively be used to screw the projectile assembly 202 into the hull 102, such as a wrench or pliers.

In inserting the wad assembly 302 and the projectile assembly 202 into the first cavity 104 of the hull 102, the rim 312 of the overpowder cup 304 of the wad assembly 302 is inserted into a circular channel 116 formed in an angled surface 114 of the first cavity 104 of the hull 102 proximate a hull second cavity 112 (wherein a primer 404 is secured by conventional methods). Such insertion of the rim 312 of the overpowder cup 304 into the circular channel 116 causes the propulsive charge 318 contained in the overpowder cup 304 to contact the angled surface 114 of the hull 102 such that the propulsive charge 318 is compressed and uniformly packed. Such uniform packing results in uniform burn when the propulsive charge 318 is ignited.

The slug assembly 402 is further assembled by inserting and securing a primer 404 within the second cavity 112 of the hull 102. The primer 404 is ordinarily inserted and secured in the second cavity 112 of the hull 102 as the first or one of the first steps in the assembly process.

Figure 7A:
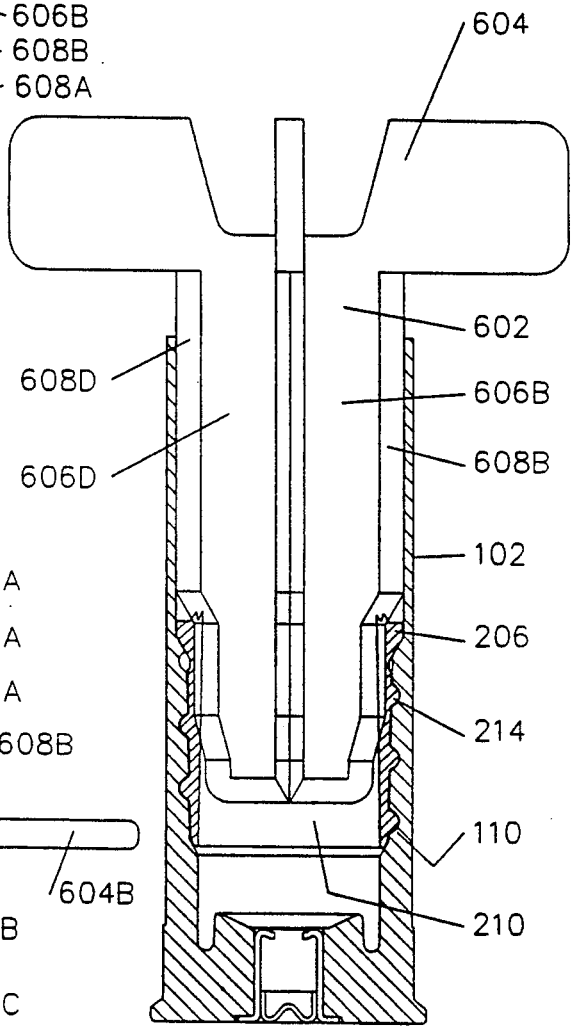
FIGS. 7A and 7B are sectional elevation views which illustrate a method for disassembling the remaining portions of a slug assembly in accordance with the present invention which has been fired from a firearm.
Figure 7B:
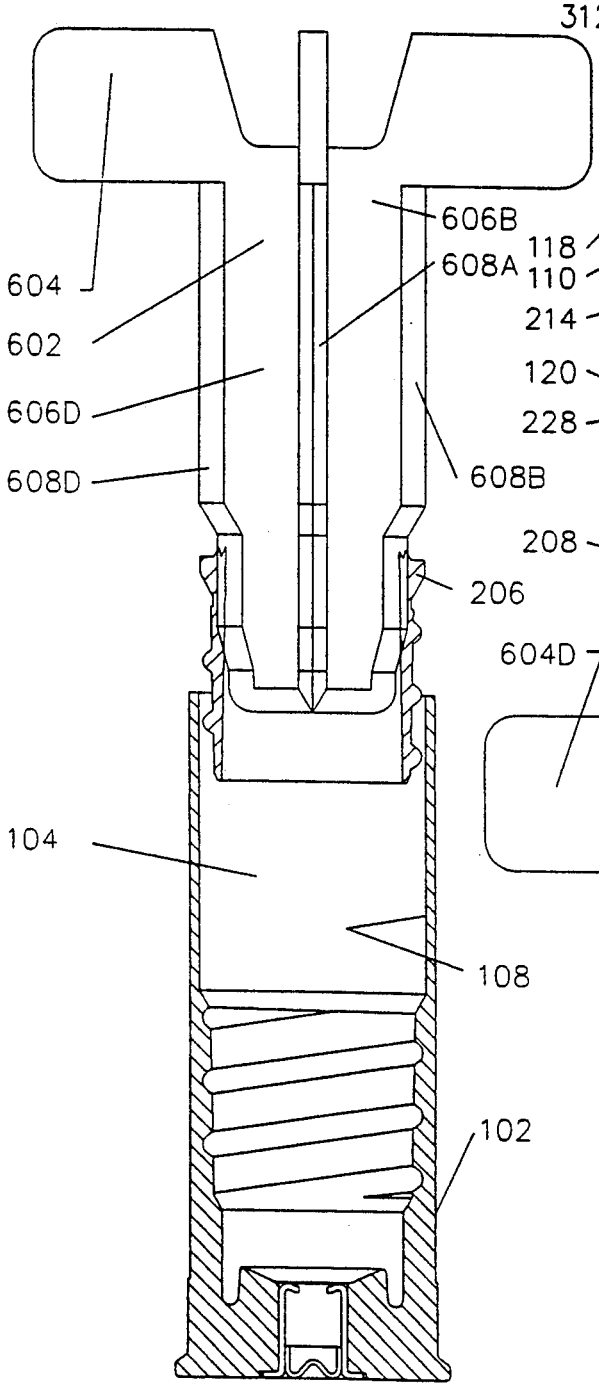

A method for disassembling the slug assembly 402 and particularly for removing the second portion 206 of the projectile assembly 202 from the hull 102 after the slug assembly 402 is fired from the barrel 506 of a firearm shall now be described with reference to FIGS. 7A and 7B. The shaft 606 of the tool 602 is inserted into the first cavity 104 of the hull 102 until the blades 608A, 608B, 608C and 608D enter the second chamber 210 of the projectile assembly 202 and penetrate the second portion 206 of the projectile assembly 202. Once the blades 608A, 608B, 608C and 608D have penetrated the second portion 206 of the projectile assembly 202, the second portion 206 is removed from the hull 102 by using the tool 602 to unscrew the first threading 110 of the hull 102 from the second threading 214 of the projectile assembly 202. After the second portion 206 of the projectile assembly 202 is removed from the first cavity 104 of the hull 102, the shaft 606 of the tool 602 is again inserted into the first cavity 104 of the hull 102 such that the blades 608A, 608B, 608C and 608D engage the inner surface 108 of the hull 102, thereby scraping residue from the inner surface 108 of the hull 102. Consequently, the hull 102 is ready for reloading and reassembly of the slug assembly 402. Note that the slug assembly 402 can be disassembled using conventional tools, such as a pocket knife.

The present invention may be embodied in other specific forms without departing from the spirit or essential attributes thereof and, accordingly, reference should be made to the appended claims, rather than to the foregoing specification, as indicating the scope of the invention.

I claim:

1. An easily reloadable slug assembly having enhanced features for achieving an accurate and dependable flight path when fired from a firearm, the slug assembly comprising:

a substantially hollow, generally cylindrically shaped hull having a first cavity formed therein, the hull comprising an outer surface, an inner surface defining the first cavity, and first retaining means formed on a portion of the inner surface within the first cavity, the hull also having a second cavity formed therein for receiving a primer;

a generally cylindrically shaped projectile assembly comprising a first portion, a second portion, a projectile secured in a first chamber formed in the first portion, and second retaining means formed on an outer surface of the second portion, the second portion and a part of the first portion of the projectile assembly being positioned within the hull first cavity and secured therein by interaction of the first and second retaining means;

a wad assembly positioned in the hull first cavity within a second chamber formed in the second portion of the projectile assembly, the wad assembly having means for receiving, measuring, and retaining in the hull first cavity a predetermined quantity of propulsive charge;

the projectile assembly further comprising a break-away area formed on the outer surface of the second portion, the break-away area having a predetermined tensile strength such that the projectile assembly is structurally weakest at the break-away area, wherein at a predetermined time after ignition of the primer inside the hull second cavity and the propulsive charge inside the hull first cavity, the projectile assembly tears at the break-away area, thereby separating the first portion from the second portion.

2. The slug assembly of claim 1, wherein the projectile assembly comprises an interior wall positioned within the projectile assembly and separating the first and second chambers from each other, and wherein the break-away area is positioned on the outer surface of the second portion a predetermined distance from the wall, such that upon tearing of the projectile assembly at the break-away area, a part of the second portion extending from the wall to the break-away area remains attached to the first portion, the attached part of the second portion forming an aerodynamic skirt during flight of the separated first portion to enhance in-flight stability of the separated first portion.

3. The slug assembly of claim 2, wherein the wad assembly further comprises a generally hollow, generally concave shaped, generally collapsible forcing portion connected to the receiving, measuring, and retaining means, the forcing portion having a generally circular edge defining an open end of the forcing portion, the circular edge of the forcing portion abutting the interior wall of the projectile assembly within the second chamber, wherein upon ignition and burning of the primer, the forcing portion partially collapses and becomes generally convex shaped as the forcing portion exerts outward pressure against the interior wall of the projectile assembly, such that outer surfaces of the forcing portion engage an inner surface of the projectile assembly second cavity and the hull first cavity inner surface, thereby rapidly sealing expanding gases resulting from ignition and burning of the primer and propulsive charge within the hull first cavity and ensuring engagement of the first and second retaining means.

4. The slug assembly of claim 2, wherein the attached part of the second portion bellows outwardly such that the attached part engages rifling grooves formed in a firearm barrel and thus causes the separated first portion to spin, thereby enhancing in-flight stability and accuracy of the separated first portion.

5. The slug assembly of claim 1, wherein the inner surface defining the hull first cavity comprises a lower surface proximate the hull second cavity, the lower surface having a circular channel formed therein, the wad assembly receiving, measuring, and retaining means comprising a cup formed in the wad assembly, the cup having a generally circular edge defining an open end of the cup to receive the predetermined quantity of propulsive charge into the cup, the circular edge of the cup being inserted into the circular channel formed in the lower surface of the hull first cavity, wherein the propulsive charge retained in the cup contacts the lower surface in the hull first cavity and is thereby compressed and uniformly packed, such that uniform burn is achieved when the propulsive charge is ignited.

6. The slug assembly of claim 1, wherein the break-away area comprises a plurality of perforations formed on the outer surface of the second portion of the projectile assembly, each of the perforations having a predetermined width, length, and depth such that the perforations have a combined tensile strength corresponding to the predetermined tensile strength of the break-away area.

7. The slug assembly of claim 1, wherein the break-away area comprises an annular groove formed on the outer surface of the second portion of the projectile assembly, the annular groove having a predefined width and depth such that the annular groove has a tensile strength corresponding to the predetermined tensile strength of the break-away area.

8. The slug assembly of claim 7, wherein the break-away area comprises a tapered entry edge to facilitate insertion of the projectile assembly into the hull first cavity.

9. The slug assembly of claim 1, wherein the first retaining means comprises a first threaded portion formed on the inner surface of the hull first cavity and the second retaining means comprises a second threaded portion formed on the outer surface of the projectile assembly second portion, the second threaded portion being complementary to the first threaded portion, such that the projectile assembly having the wad assembly positioned within the projectile assembly second chamber can be easily inserted, positioned, and secured within the hull first cavity.

* * * * *